United States Patent [19]

Marco et al.

[11] Patent Number: 5,038,928

[45] Date of Patent: Aug. 13, 1991

[54] CARRIER STOCK WITH INTEGRAL HANDLES

[75] Inventors: Leslie S. Marco, Bloomingdale; Robert Olsen, Medinah, both of Ill.

[73] Assignee: Illinois Tool Works Inc., Glenview, Ill.

[21] Appl. No.: 519,858

[22] Filed: May 7, 1990

[51] Int. Cl.[5] ..... B65D 75/56; B65D 71/00

[52] U.S. Cl. ..... 206/162; 206/150; 206/428

[58] Field of Search ..... 206/428, 139, 150, 162

[56] References Cited

U.S. PATENT DOCUMENTS

| | | | |
|---|---|---|---|
| 3,314,712 | 1/1965 | Hohl et al. | 294/87.2 |
| 3,792,562 | 2/1974 | Gilliam | 206/428 |
| 4,356,914 | 11/1982 | Olsen et al. | 206/150 |
| 4,520,924 | 6/1985 | Edwards et al. | 206/150 |
| 4,523,676 | 6/1985 | Barrash | 206/150 |
| 4,624,363 | 11/1986 | Edwards | 206/150 |

*Primary Examiner*—William I. Price

*Attorney, Agent, or Firm*—Dressler, Goldsmith, Shore, Sutker & Milnamow, Ltd.

[57] ABSTRACT

Carrier stock formed from a single sheet of resilient polymeric material, such as low density polyethylene, and severable into individual carriers with integral handles. For each carrier, integrally joined band segments define container-receiving apertures. Moreover, an integral handle is joined at its ends respectively to middle portions of two outer segments, which are joined to one cross segment at a node. Stresses are distributed from each end of the handle, through the outer segment having such end joined to a middle portion thereof, to two cross segments. Perforated lines divide alternate cross segments into half segments and facilitate severance of such stock to form the individual carriers. Each half segment has an aperture-defining edge configured to provide means, which may comprise a nub, for countering tendencies of such half segment to neck down or to break. The handle has a middle leg, which is joined to the node via a frangible joint, as defined by a perforated line extending across the middle leg. The frangible joint is designed to break away when stressed.

12 Claims, 2 Drawing Sheets

CARRIER STOCK WITH INTEGRAL HANDLES

TECHNICAL FIELD OF THE INVENTION

This invention pertains to carrier stock for machine application to substantially identical cans or other containers. This invention pertains, more particularly, to carrier stock that is severable into individual carriers with separate apertures to receive the individual containers and with integral handles.

BACKGROUND OF THE INVENTION

Typically, carrier stock with individual container-receiving apertures for machine application to substantially identical containers is formed, as by die-cutting, from a single sheet of resilient polymeric material, such as low density polyethylene.

An example of such stock for machine application to substantially identical containers in three longitudinal rows of indeterminate length is disclosed in Klygis U.S. Pat. No. 4,018,331. As disclosed therein, such stock may be transversely severed, after it has been applied to such containers, to produce packages with three containers, six containers, or other multiples of three containers. A suitable machine for applying such stock is disclosed in Benno et al. U.S. Pat. No. 3,959,949.

Heretofore, carrier stock formed from a single sheet of resilient polymeric material, such as low density polyethylene, for machine application to substantially identical containers and severable into individual carriers with separate apertures to receive the individual containers has not been available with integral handles on such carriers.

SUMMARY OF THE INVENTION

This invention provides carrier stock formed from a single sheet of resilient polymeric material, such as low density polyethylene, for machine application to substantially identical containers. Such stock is severable to form individual carriers with integral handles. The carrier stock is formed with several characteristic features for each individual carrier.

Thus, for each individual carrier, such stock is formed with integrally joined band segments defining the separate apertures. Such segments include outer segments and cross segments. The outer segments extend generally in a longitudinal direction when such stock is unstressed. The cross segments extend generally in a transverse direction when such stock is unstressed. Each outer segment is joined at each end to one of the cross segments.

Moreover, for each individual carrier, such stock is formed with an integral handle having two ends. Each end of the handle is joined integrally to a middle portion of one of the outer segments so that stresses are distributed from the handle, through the same one of the outer segments, to two of the cross segments.

In a preferred arrangement, the separate apertures are in a rectangular array with longitudinal rows and transverse ranks. Also, selected ones of the cross segments to which stresses from the ends of the handle are distributed have weakened lines, such as perforated lines, which extend generally in a transverse direction when such stock is unstressed. Preferably such segments are alternate cross segments, which are spaced longitudinally from a node where two of the outer segments and another of the cross segments are joined. The weakened lines divide such segments into half segments and facilitate severance of such stock to form the individual carriers. Each half segment is partly bounded by one of the weakened lines.

When stressed by handling through the handle, each half segment has tendencies to neck down or to break, particularly if the weakened line that partly bounds such half segment is perforated. A perforated line produces stress concentrations, which are exacerbated if a transversely moving plow or other force-transmitting means is forced between the individual carriers. Such a means tends to produce small nicks or width reductions of the half segments. It is preferred, therefore, that each half segment has an aperture-defining edge configured to provide means for countering such tendencies. Such means may comprise a nub formed along such edge.

Thus, in a preferred arrangement, the aperture-defining edge is configured with two concave sections and one convex section defining a nub between the concave sections. The nub counters tendencies of such half to neck down or to break because of stress concentrations along the perforated line that partly bounds such half. Preferably, moreover, the aperture-defining edge is configured to provide smooth transitions between the concave and convex sections.

As a further feature, the handle may have a middle leg, which is joined to the node via a break-away joint. The break-away joint may be defined by a perforated line extending across the middle leg.

The carrier stock may be advantageously combined with a rectangular array of substantially identical containers to form a package. Each container has a side wall at which such container is gripped by the band segment defining one of the separate apertures.

These and other objects, features, and advantages of this invention are evident from the following description of a preferred embodiment of this invention with reference to the accompanying drawings.

DETAILED DESCRIPTION OF PREFERRED EMBODIMENT

Figure 1:
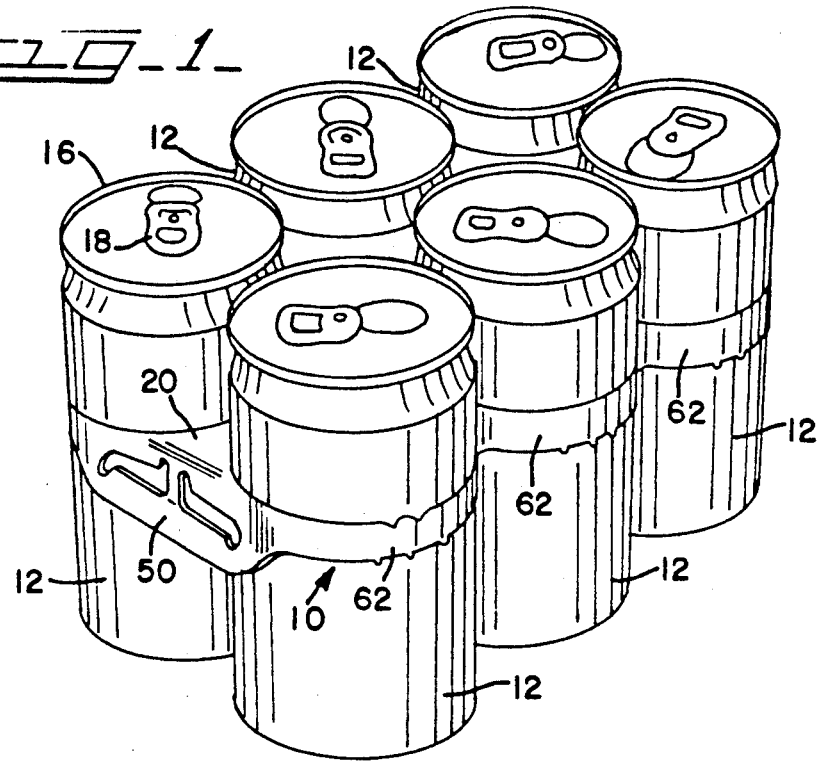
FIG. 1 is a perspective view of a package comprising six identical containers and a carrier, which has an integral handle, and which is severed from carrier stock according to this invention.
Figure 3:
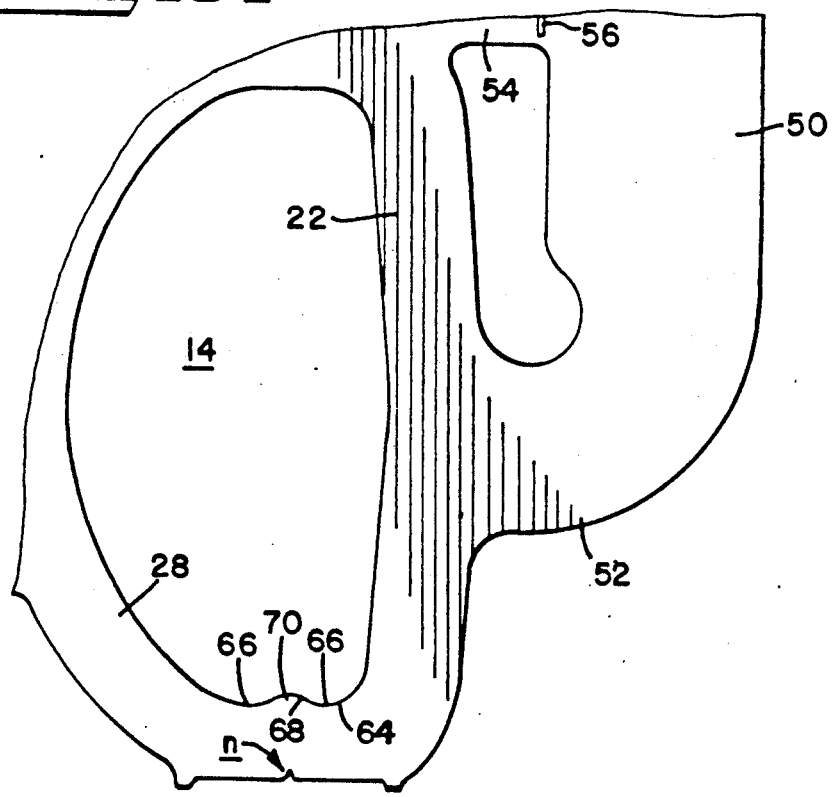
FIG. 3 is an enlarged detail taken from FIG. 2 to show small nicks on an aperture-defining edge of such stock and to show a nub formed on such edge.
Figure 2:
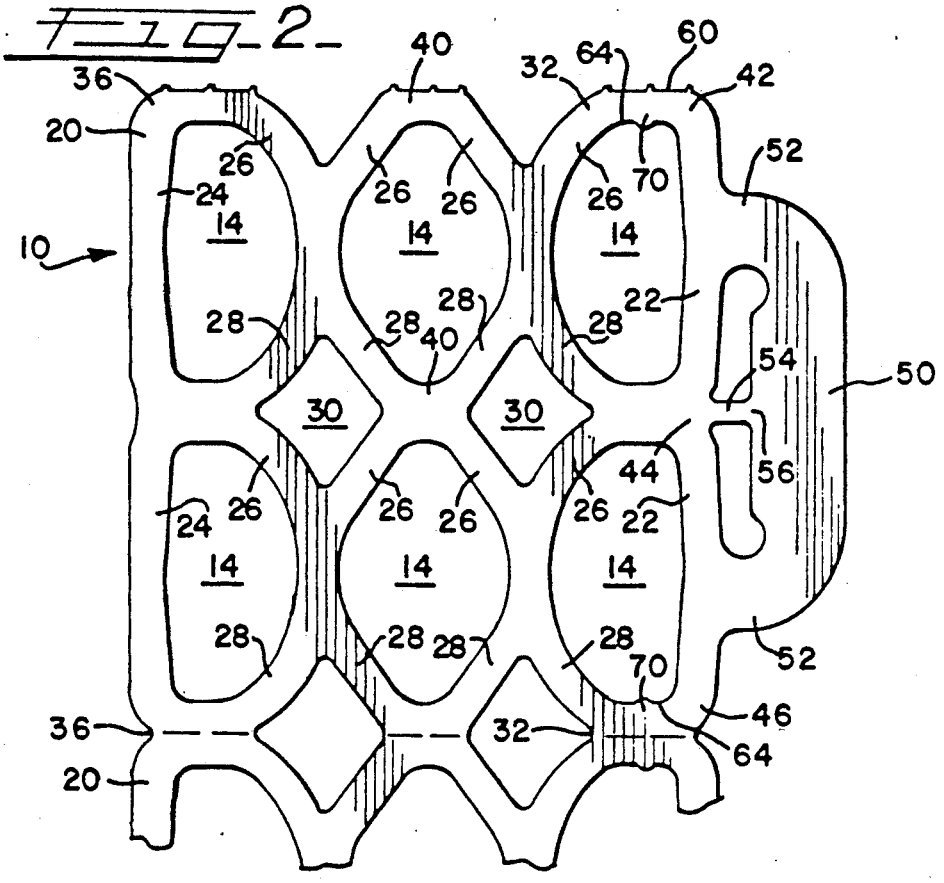
FIG. 2 is a plan view of carrier stock according to a preferred embodiment of this invention.

As shown in FIGS. 1 through 3, carrier stock 10 for machine application to substantially identical containers 12 constitutes a preferred embodiment of this invention. Such stock 10 is formed with separate apertures 14 to receive the individual containers 12. The carrier stock 10 is severable, along transverse lines to be later described, to form individual carriers 20 that are substantially identical.

As shown in FIG. 1, the containers 12 are beverage cans of a type used commonly for beer, soft drinks, and other beverages. Also, each container 12 has a chime 16 at one end, which is provided with a pull tab 18. This invention is not limited, however, to usage with such cans but is useful with cans, bottles, and other containers of various types.

In FIG. 1, a package is shown, which comprises six such containers 12 and one such carrier 20, as severed from such stock 10. One such carrier 20 is shown fully in FIG. 2, which also shows fragmentary portions of the next carrier 20. Each carrier 20 is shown in an unstressed condition in FIG. 2.

The carrier stock 10 is formed in an indeterminate length, as by die-cutting, from a single sheet of resilient polymeric material. A preferred material is low density polyethylene. A preferred thickness for such stock 10 in an unstressed condition, if low density polyethylene is used, is about 14 mils.

The carrier stock 10 is formed, for each individual carrier 20, with integrally joined band segments defining six separate apertures 14. As shown in FIG. 2, such apertures are in a rectangular array with longitudinal rows and transverse ranks, namely three longitudinal rows and two transverse ranks for each individual carrier 20.

The carrier stock 10 is applied to the side walls of the respective containers 12 away from the chime 16 of each container 12. The carrier stock 10 may be applied as the carrier stock disclosed in Klygis U.S. Pat. No. 4,018,331 is applied. A suitable machine for applying such stock 10 is disclosed in Benno et al. U.S. Pat. No. 3,959,949.

A preferred machine for applying the carrier stock 10 is disclosed in a co-pending application filed simultaneously herewith, by Lonnie Ray Seymour and Kevin Dewain Moore, under Ser. No. 07/519860, and assigned commonly herewith, for "Apparatus and Method for Applying Multi-Package Device."

Because the carrier stock 10 is applied to the side walls of the respective containers 12, the carrier stock 10 requires less material and can be thus made of thinner material and/or band segments of narrower widths, as compared to carrier stock (not shown) applied directly beneath chimes like the chimes 16, which are abutted by edges of such stock.

The band segments include relatively narrow outer and diagonal segments and relatively wide cross segments. The outer segments include outer segments 22 extending along what may be hereinafter called the handle edge of the carrier stock 10 and outer segments 24 extending along the opposite edge of such stock 10. The outer segments 22, 24, extend generally in a longitudinal direction, which is the machine direction, when such stock 10 is unstressed. The diagonal segments 26, 28, extend generally along diagonal lines when such stock 10 is unstressed and define generally diamond-shaped apertures 30. The cross segments include cross segments 32, 34, joined directly to the outer segments 22 at the handle edge, cross segments 36, 38, joined directly to the outer segments 24 at the opposite edge, and cross segments 40 extending between the apertures 30. Unless severed in manner to be later described, the cross segments 32 are shared by successive ones of the individual carriers 20 that are severable from the carrier stock 10.

Because the carrier stock 10 is formed with the generally diamond-shaped apertures 30 defined by the diagonal segments 26, 28, excess material is omitted from such stock 10. There are consequent savings in cost and weight.

The carrier stock 10 is formed, for each individual carrier 20, with nodes 42, 44, 46, where the cross segments 32, 34, and the outer segments 22 are joined and with similar nodes where the cross segments 36, 38, and the outer segments 24 are joined. The node 44, to which the cross segment 34 is joined, is between the nodes 42, 46, to which the cross segments 32 are joined.

Moreover, for each individual carrier 20, the carrier stock 10 is formed with an integral handle 50. The handle 50 has two ends 52 and a middle leg 54 between the ends 52. The middle leg 54 is joined to the node 44 via a perforated line 56 defining a break-away joint. The break-away joint enables the middle leg 54 to be easily broken away from other portions of the handle 50. Once the middle leg 54 has been broken away, the handle 50 and the outer segments 22 define a finger aperture that can be sufficiently large to accommodate four fingers of a user's hand.

Each end 52 of the handle 50 is joined to other portions of the carrier stock 10, in a manner contemplated by this invention, so that stresses from the handle 50 are distributed substantially evenly to two cross segments at each end 52 of the handle 50. Such stresses are distributed to the cross segment 34, which is joined at the node 44, as well as to the cross segments 32, which are joined at the nodes 42, 44. Specifically, each end 52 of the handle 50 is joined to a middle portion of one of the outer segments 22 joined at the node 44, rather than to an end portion of one of the outer segments 22.

The cross segments 32 joined at the nodes 42, 46, have perforated (weakened) lines 60 dividing such segments 32 into half segments 62. Such segments 32 are shared by successive carriers 20 until such segments 32 are severed along such lines 60. Similar lines divide the cross segments 36 and the cross segments 40 between the cross segments 32, 36, into half segments. The perforated lines facilitate severance of the carrier stock 10 transversely to form the individual carriers 20. Such stock 10 can be manually broken or otherwise severed along such lines. Each half segment 62 is partly bounded by one such line 60, which produces stress concentrations in such half segment 62.

The carrier stock 10 can be transversely severed by a transversely moving plow (not shown) or other force-transmitting means forced between the individual carriers 20. Such a means tends to produce small nicks or width reductions n. one of which is shown in FIG. 3, or other flaws exacerbating stress concentrations in the half segments 62.

Each half segment 62 has an aperture-defining edge 64 with a characteristic shape contemplated by this invention. Specifically, such edge 64 is configured with two concave sections 66 and one convex section 68 between the concave sections 66. Such edge 64 is configured to provide smooth transitions between the concave sections 66 and the convex section 68.

The convex section 68 defines a nub 70, which effectively functions as means for countering tendencies of such half segment 62 when stressed to neck down or to break because of stress concentrations produced by the perforated line 60 that partly bounds such half segment 62. The nub 70 provides a localized region of augmented cross section with smooth transitions to adjacent regions of such half segment 62.

Preferably, the carrier stock 10 has an asymmetrical configuration, as disclosed in Olsen et al. U.S. Pat. No. 4,356,914.

Figure 4:
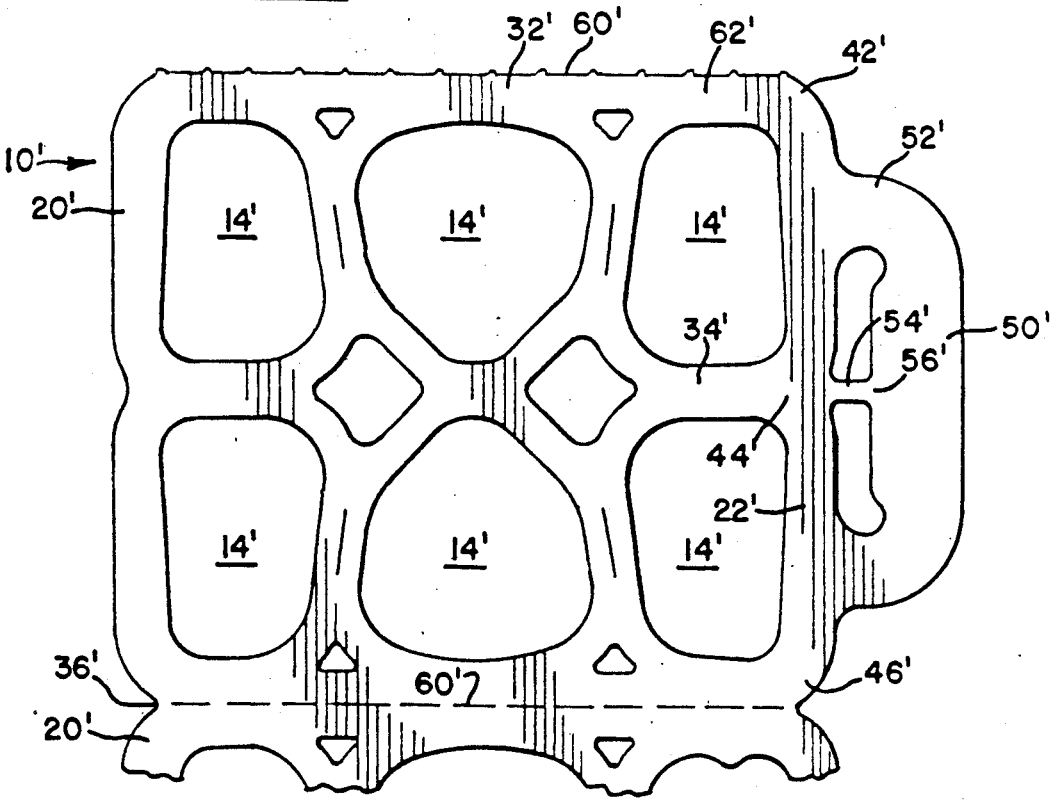
FIG. 4 is a plan view of carrier stock according to an alternate embodiment of this invention.

Carrier stock 10' constituting an alternate embodiment of this invention is shown in FIG. 4, in which primed reference numbers are used to designate elements corresponding for purposes of this invention to elements designated by those reference numbers (unprimed) in FIGS. 1, 2, and 3.

Broadly, the carrier stock 10' is similar to the carrier stock 10. However, the carrier stock 10' differs from the carrier stock 10 in many details. Such details are disclosed in a co-pending application filed simultaneously herewith, by Leslie S. Marco, Mindangas Julius Klygis and William N. Weaver, under Ser. No. 07/519,859, and assigned commonly herewith, for "Carrier Stock With Band Segments Extending Between Opposite Edges." Specific details of the carrier stock 10', beyond those details disclosed herein, may be found by reference to the co-pending application noted in the preceding sentence.

The carrier stock 10' is severable, generally as the carrier stock 10 is severable, into individual carriers 20'. The carrier stock 10' is formed, for each individual carrier 20', with integrally joined band segments defining six container-receiving apertures 14'.

The band segments of the carrier stock 10' include outer band segments 22', 24', which correspond for purposes of this invention to the outer band segments 22, 24, of the carrier stock 10. Also, the band segments of the carrier stock 10' include cross segments 32', 34', 36', which correspond for purposes of this invention to the cross segments 32, 34, 36, of the carrier stock 10. However, the cross segments 32' extend entirely across the carrier stock 10', as contrasted with the cross segments 32 of the carrier stock 10. The carrier stock 10' is formed, for each individual carrier 20', with nodes 42', 44', 46', which correspond for purposes of this invention to the nodes 42, 44, 46, of each individual carrier 20 from the carrier stock 10.

Moreover, for each individual carrier 20', the carrier stock 10' is formed with an integral handle 50', which corresponds to the handle 50 of each individual carrier 20 from the carrier stock 10. The handle 50' has two ends 52' and a middle leg 54'. The middle leg 54' is joined to the node 44' via a perforated line 56' defining a break-away joint. The break-away joint enables the middle leg 54' to be easily broken away from other portions of the handle 50'.

Each end 52' of the handle 50' is joined to other portions of the carrier stock 10', in a manner similar to the manner wherein each end 52 of the handle 50 is joined to other portions of the carrier stock 10, so that stresses from the handle 50' are distributed substantially evenly to two cross segments at each end 52', of the handle 50'. Such stresses are distributed to the cross segment 34', which is joined at the node 44' as well as to the cross segments 32', which are joined at the nodes 42', 46'.

The cross segments 32' joined at the node 42' and the cross segment 32' joined at the node 46' have perforated (weakened) lines 60' dividing such shared segments 32' into half segments 62'. Such lines 60' facilitate severance of the carrier stock 10' transversely to form the individual carriers 20'. Such stock 10' can be manually broken or otherwise severed along such lines 60'. Each half segment 62' is partly bounded by one such line 60', which produces stress concentrations in such half segment 62'.

Various modifications may be made in the carrier stock 10, or in the carrier stock 10', without departing from the scope and spirit of this invention.

We claim:

1. Carrier stock for machine application to substantially identical containers, said stock being formed from a single sheet of resilient polymeric material and being severable to form individual carriers with separate apertures to receive the individual containers and with integral handles, said stock being formed for each individual carrier with (a) integrally joined band segments defining the separate apertures and including outer segments that extend generally in a longitudinal direction when said stock is unstressed and cross segments that extend generally in a transverse direction when said stock is unstressed, each outer segment being joined at each end to one of the cross segments, and (b) an integral handle having two ends, which are joined respectively to middle portions of two of the outer segments in such manner that stresses are distributed substantially evenly from each end of the handle, through the outer segment having such end joined to a middle portion thereof, to two of the cross segments.

2. The carrier stock of claim 1 wherein the separate apertures for each individual carrier are in a rectangular array with longitudinal rows and transverse ranks.

3. The carrier stock of claim 2 wherein selected ones of the cross segments to which stresses from the ends of the handle are distributed have weakened lines extending generally in a transverse direction when said stock is unstressed and dividing the segments having said lines into half segments, said lines facilitating severance of said stock to form the individual carriers.

4. The carrier stock of claim 3 wherein each half segment has an aperture-defining edge configured to provide means for countering tendencies of such half segment when stressed to neck down or to break.

5. The carrier stock of claim 4 wherein said means comprises a nub formed along the aperture-defining edge.

6. The carrier stock of claim 3 wherein the weakened lines are perforated.

7. The carrier stock of claim 2 combined with a rectangular array of substantially identical containers to form a package, each container having a side wall, at which such container is being gripped by the band segments defining one of the apertures.

8. Carrier stock for machine application to substantially identical containers, said stock being formed from a single sheet of resilient polymeric material and being severable to form individual carriers with separate apertures to receive the individual containers and with integral handles, said stock being formed for each individual carrier with (a) integrally joined band segments defining the separate apertures and including outer segments that extend generally in a longitudinal direction when said stock is unstressed and cross segments that extend generally in a transverse direction when said stock is unstressed, each outer segment being joined at each end to one of the cross segments, (b) a node where two of the outer segments and one of the cross segments are joined, and (c) an integral handle having two ends, which are joined respectively to middle portions of the outer segments joined at the node in such manner that stresses are distributed from each end of the handle, through each outer segment having such end joined to a middle portion thereof, to two cross segments, wherein alternate ones of the cross segments are spaced longitudinally from the node and have perforated lines extending generally in a transverse direction when said stock is unstressed and dividing the segments having said lines into half segments, said lines facilitating severance of said stock to form individual carriers, each half segment being partly bounded by one of the perforated lines, each half segment having an aperture-defining edge configured with two concave sections and one convex section defining a nub between the concave sections, the nub constituting means for countering tendencies of such half segment when stressed to neck down or to break because of stress concentrations along the perforated line that partly bounds such half segment.

9. The carrier stock of claim 8 wherein the aperture-defining edge is configured to provide smooth transitions between the concave and convex sections.

10. The carrier stock of claim 9 wherein the handle has a middle leg, which is joined to the node via a breakaway joint.

11. The carrier stock of claim 10 wherein the breakaway joint is defined by a perforated line extending across the middle leg.

12. The carrier stock of claim 8 combined with a rectangular array of substantially identical containers to form a package, each container having a side wall, of which such container is gripped by the band segments defining one of the apertures.

* * * * *